United States Patent [19]

Karll

[11] 4,083,196

[45] Apr. 11, 1978

[54] COMPRESSOR REFRIGERATION PLANT

[75] Inventor: Bent Karll, Augustenborg, Denmark

[73] Assignee: Danfoss A/S, Nordborg, Denmark

[21] Appl. No.: 744,632

[22] Filed: Nov. 24, 1976

[30] Foreign Application Priority Data

Nov. 28, 1975 Germany ..... 2553562

[51] Int. Cl.[2] ..... F25B 41/06

[52] U.S. Cl. ..... 62/200; 62/223; 62/511

[58] Field of Search ..... 219/504, 505; 62/511, 62/223, 222, 528, 527, 200

[56] References Cited

U.S. PATENT DOCUMENTS

| | | | |
|---|---|---|---|
| 2,685,780 | 8/1954 | Zearfoss, Jr. | 62/511 |
| 3,564,199 | 2/1971 | Blaha | 219/205 X |
| 3,638,447 | 2/1972 | Abe | 62/222 |
| 3,940,591 | 2/1976 | Ting | 219/205 X |

*Primary Examiner*—William E. Wayner

[57] ABSTRACT

The invention relates to a temperature control system for refrigeration unit. In this system a capillary tube extends between the condenser and the evaporator and a chamber upstream from at least a section of the capillary tube contains a PTC resistor. The PTC resistor is supplied with current in response to a thermostatic sensing of a predetermined low temperature in the room or compartment which contains the evaporator. In response thereto the PTC resistor generates enough heat to produce a vapor plug which throttles of stops the flow of refrigerant in the capillary section but not enough heat to cause coking of the refrigerant oil which would permanently plug the capillary tube. The downstream capillary section is so dimensioned that it is permeable to liquid refrigerant but is substantially impermeable to the refrigerant vapor generated in the chamber.

6 Claims, 3 Drawing Figures

COMPRESSOR REFRIGERATION PLANT

Figure 1:
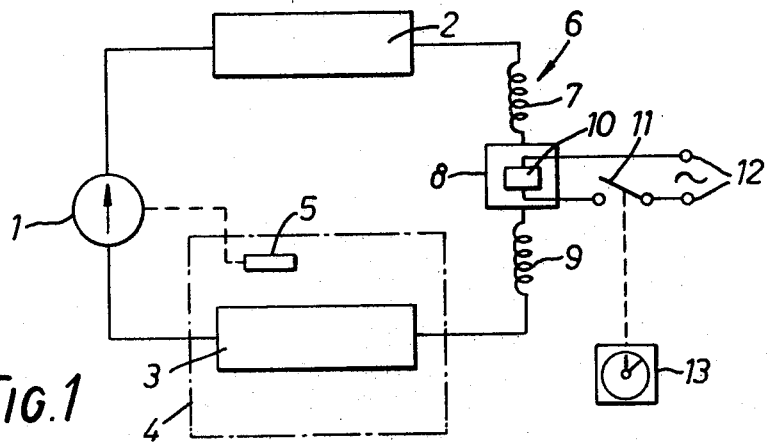

The invention relates to a compressor refrigeration plant comprising a capillary tube between the condenser and evaporator and, associated with the capillary tube, an intermittently operable electric heating resistor.

It is known to heat the capillary tube or a conduit section immediately upstream thereof by means of an electric heating resistor, to evaporate the refrigerant that is there located and in this way to produce a vapour plug which is practically impossible to discharge through the capillary tube. With the aid of the heating resistor, therefore, the downstream evaporator can be made inoperative by means of the refrigerant supply. This is utilised to regulate the temperature in a refrigerated compartment independently of the control of the compressor or to relieve the evaporator when the latter is to be defrosted with the aid of an additional defrosting device.

In the known cases, the heating resistor has a constant heat output and is disposed beyond the capillary tube or the refrigerant conduit. However, this results in the disadvantage that, after the refrigerant has evaporated, an excessive heat output is available that leads to an excessive temperature rise and permits coking of the refrigerant oil that is initially dissolved in the refrigerant and has been released by the evaporation. Since this coking takes place in the capillary tube or immediately upstream thereof, blockages of the capillary tube are unavoidable.

The invention is therefore based on the problem of providing a compressor refrigerator plant of the aforementioned kind in which there is no fear of a blockage of the capillary tube by carbonized oil.

This problem is solved in accordance with the invention in that a chamber is provided upstream of at least a section of the capillary tube and that the electric heating resistor is a PTC resistor which is disposed in the chamber and which goes over from a low to a high resistance when a temperature range is exceeded between the evaporating temperature of the refrigerant associated with the pressure in the chamber and the coking temperature of the refrigerant oil.

With this arrangement, the heating resistor is disposed in the refrigerant and therefore has the same temperature as the refrigerant. Since the heatng resistor is a PTC resistor, its resistance increases with a rise in temperature and its power output drops accordingly. There are markedly different resistances to both sides of a temperature range; with many PTC resistors, a surge of resistance is associated with a particular temperature. When the PTC resistor is switched on, therefore, an equilibrium temperature is set up at which the refrigerant can evaporate but the refrigerant oil cannot become coked. There is therefore no danger of blocking the capillary tube.

As in known cases, such an apparatus can be used as a 'switch' for the refrigerant in so far that the downstream capillary tube section is so dimensioned that it is permeable to liquid refrigerant but is practically impermeable to the refrigerant vapour produced in the chamber.

In this way it is possible to control a refrigerant cabinet with two compartments of different temperature having their evaporators connected substantially in parallel and fed by a common compressor and condenser, in so far that a thermostat in the compartment of lower temperature controls the compressor and a thermostat in the compartment of higher temperature controls a switch for the PTC resistor.

The fact that the PTC resistor tends to ensure a substantially uniform temperature in the chamber when it is operative also permits a very simply constructed defrosting apparatus to be provided which dispenses with expensive accessories such as magnetic valves for hot gas, special heating conduits at the evaporator, and the like. Such a defrosting apparatus is characterised in that the chamber is disposed between two capillary tube sections and the second capillary tube section is dimensioned so that it has a lower throttling resistance to the liquid refrigerant than does the first capillary tube section. In particular, it can be dimensioned so that the second capillary tube section offers substantially the same resistance to refrigerant vapour as both sections do to liquid refrigerant. This can be achieved in that, for the second capillary tube section, its length is selected to be shorter than for the first capillary tube section and/or its cross-section is selected to be larger. In this case, when the PTC resistor is operative it will continuously convert liquid refrigerant to superheated refrigerant vapour in the chamber. In vapour is throttled in its flow into the evaporator and effects defrosting. With the dimensions as stated, it is even possible to ensure that, during defrosting, the pressure in the evaporator is substantially the same as the evaporator pressure during normal operation.

It is particularly favourable if there is a functional relationship between the compressor and the PTC resistor such that the compressor is at least temporarily functioning during defrosting. In this way the compressor sucks off the refrigerant vapour fed into the evaporator. The low suction also ensures that no excessively high evaporator pressures occur. At the same time, the condenser is filled so that, after defrosting, the original temperature can be rapidly re-establishd in the refrigerated space.

This functional relationship may be given in many ways. For example, the switch for the PTC resistor can also energise the compressor motor. However, the defrosting circuit can also be coupled to the compressor circuit in any other manner, either mechanically, electrically or thermally. A very simple solution is obtained if the PTC resistor is operable deliberately or automatically, e.g. in response to the presence of a layer of frost on the evaporator, and the compressor is controllable by a thermostat in the refrigerated space. Switching on of the PTC resistor can be controlled manually, by a time clock, by a temperature sensor or the like. In each case, the subsequent interruption in the supply of the liquid refrigerant leads to heating of the refrigerated space which, in turn, allows the compressor to start by way of the thermostat.

Figure 2:
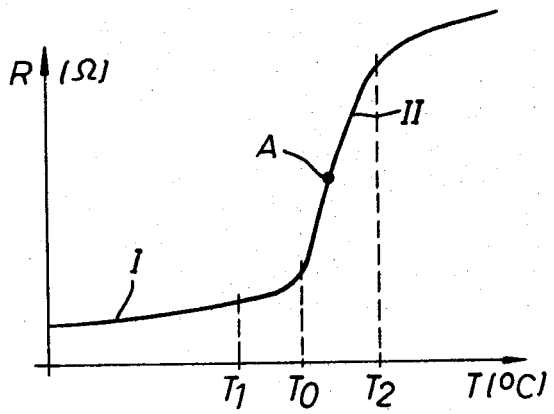
Figure 3:
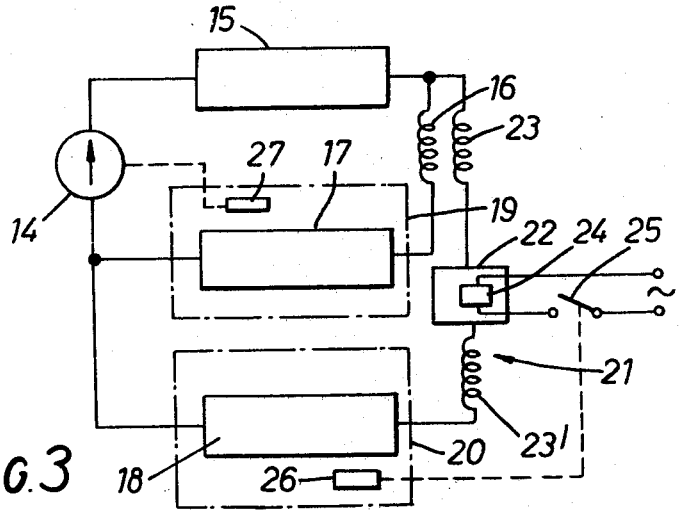

The invention will now be described in more detail with reference to examples diagrammatically illustrated in the drawing, wherein:

FIG. 1 is the circuit diagram of a compressor refrigeration plant having a defrosting apparatus according to the invention, FIG. 2 shows the characteristic curve of a PTC resistor that is used, and FIG. 3 is the circuit diagram of a compressor refrigeration plant with two refrigerated compartments of different temperature.

The circuit according to FIG. 1 contains in its cycle a compressor 1, a condensor 2 and evaporator 3. The latter is accommodated in a refrigerated space 4. Its temperature is monitored by a thermostat 5 which switches the compressor 1 on and off as may be required. Between the condenser 2 and evaporator 3 there is a capillary tube arrangement 6 consisting of a first capillary tube section 7, a chamber 8 and a second capillary tube section 9. The two capillary tube sections 7 and 9 are dimensioned with regard to their throttling resistance such that liquid refrigerant from the condenser 2 and under the pressure of the condenser reaches the evaporator 3 in an expanded form by an amount required for normal operation and there evaporates by absorbing heat.

In the chamber 8 there is a heating resistor in the form of a PTC resistor 10 which can be applied to mains terminals 12 by a switch 11. The switch 11 is actuated by a time clock 13 which initiates a defrosting period of for example 1 hour in predetermined time intervals, e.g. every 72 hours.

The PTC resistor 10 has a characteristic curve corresponding to the diagram of FIG. 2. At low temperatures, there is a flat curve section I with a comparatively low resistance R. This is followed substantially above a surge temperature $T_0$ by a steeper curve section II which leads to very high resistance R. The PTC resistor 10 is selected so that an evaporating temperature $T_1$ is associated with a low resistance R whereas there is a high resistance during a temperature $T_2$ at which coking of the refrigerant oil would take place. On switching the PTC resistor on, i.e. when the chamber 8 is filled with liquid, the PTC resistor operates along the curve section I with a correspondingly high heat output. When evaporation has been concluded, the temperature of the refrigerant vapour rises, as does tht of the PTC resistor, so that the heat output is reduced. A condition of equilibrium is set up at the operating point A disposed on the curve section II and in every case located below the coking temperature $T_2$. The second capillary tube section 9 is dimensioned so that a marked amount of refrigerant vapour can flow from the chamber 8 into the evaporator 3. When the liquid refrigerant in the chamber 8 evaporates, the pressure conditions in the capillary tube arrangement 6 change from those during normal operation. This is because the volume of the refrigerant vapour is several times larger than the volume of the liquid refrigerant. The volume of refrigerant vapour flowing out through the second capillary tube section 9 therefore compares with a much smaller volume of the liquid refrigerant flowing in through the first capillary tube section 7. The pressure in the chamber 8 therefore rises as compared with normal operation. Whereas during normal operation the pressure drop takes place almost entirely in the first capillary tube section 7, it occurs substantially only in the second capillary tube section during defrosting. As a result of the heating, the refrigerant vapour flowing out through the second capillary tube section 9 is sufficiently hot to melt the frost on the evaporator 3. In particular, the refrigerant vapour in the chamber 8 is over-heated up to the temperature of the operating point A. By switching the compressor 1 on, the refrigerant vapour is sucked out of the condenser 3 so that there can be a continuous replenishment of hot vapour.

Switching on of the compressor takes place automatically in response to switching on of the PTC resistor 10 by means of the time-clock 13. This is because when no liquid refrigerant but only hot refrigerant vapour flows into the condenser 3, the temperature in the refrigerated space 4 rises and the thermostat 5 responds to switch on the compressor 1. When the compressor 1 is operative but the liquid refrigerant is discharged from the condenser 2 to a reduced extent, the condenser is more intensively filled with liquid refrigerant. After defrosting, an adequate refrigeration effect is then available in order to bring the temperature of the refrigerated space 4 rapidly back to the desired intended value.

In the embodiment according to FIG. 3, a compresser 14 feeds an evaporator 17 by way of a condenser 15 and capillary tube 16 and it feeds an evaporator 18, which is connected in parallel, by way of a capillary tube arrangement 21. The evaporator 17 is arranged in a first refrigerated compartment 19 of lower temperature and the evaporator 18 is disposed in a second refrigerated compartment 20 of higher temperature. The capillary tube arrangement 21 consists of a chamber 22, an upstream capillary tube section 23 and a downstream capillary tube section 23'. In the chamber 22 there is again a PTC resistor 24 which is applied to mains terminals by a switch 25. the switch 25 is operated by a thermostat 26 when the temperature of the refrigerated compartment 20 becomes too high. The temperature in the refrigerated compartment 19 is monitored by a thermostat 27 which controls the compressor 14 directly.

With this circuit, the capillary tube arrangement 21 serves as a switch for starting and stopping the evaporator 18. When the PTC resistor 24 is energised, the liquid refrigerant in the chamber 22 evaporates. The capillary tube section 23' is designed so that it is practically impermeable to refrigerant vapour. Consequently, liquid refrigerant is no longer fed to the evaporator 18. The entire refrigeration effect is supplied only to the refrigerated compartment 19 of lower temperature. If the temperature here drops below the set desired value, the compressor is switched off. In this way the two refrigerated compartments can be independently regulated to acquire the required temperature. Nevertheless, it is here also ensured that the capillary tube section 23 cannot be blocked by coked oil.

In an example of the circuit according to FIG. 1, the refrigeration plant was designed as follows:

| | |
|---|---|
| Compressor 1 | 1/5 HP |
| Refrigerant | R 12 |
| Capillary tube section 7 | |
| Length | 3.0 m |
| Internal diameter | 0.8 mm |
| Capillary tube section 9 | |
| Length | 2.0 m |
| Internal diameter | 1.0 mm |
| PTC resistor 10 Cold resistance | 25 ohm |
| Surge temperature $T_O$ | 80° C |

During defrosting, there was a condenser pressure of 14 atmospheres, a pressure in the chamber 8 of 10 atmospheres and a suction pressure of 1.5 atmospheres in such a plant.

The evaporating temperature $T_1$ in the chamber amounted to 40° C. The PTC resistor 10 assumed a temperature of 90° C at the operating point A. The coking temperature of $T_2$ for the refrigerant oil is approximately 180° C.

I claim:

1. A refrigeration unit comprising a compressor, a condenser, an evaporator, capillary tube section extending between and in series with said condenser and said evaporator, a chamber upstream from said capillary section, a PTC resistor in said chamber, said PTC resistor having an operating range wherein a low resistance corresponds to an evaporating temperature T1 and a high resistance corresponding to the refrigerant oil coking temperature T2, and circuit means including switch means for providing current to said resistor.

2. A refrigeration unit according to claim 1 wherein said capillary tube section is dimensioned to be permeable to liquid refrigerant and substantially impermeable to refrigerant vapour generated in said chamber.

3. A refrigeration unit according to claim 2 including a second evaporator in parallel with said first named evaporator, a cabinet having first and second high and low temperature compartments for said first and second evaporators, a thermostat in said second compartment for controlling said compressor, and a thermostat in said first compartment for controlling said switch means.

4. A refrigeration unit according to claim 2 including a second capillary tube section upstream from said chamber, said first named tube section being dimensioned to have a lower throttling resistance to liquid refrigerant than said second capillary tube section.

5. A refrigeration unit according to claim 4 wheein said first named capillary tube section offers substantially the same resistance to refrigerant vapour as both of said sections do to liquid refrigerant.

6. A refrigeration unit according to claim 4 wherein said compressor operates at least temporarily during defrosting.

* * * * *